US006432592B1

(12) United States Patent
Ryu

(10) Patent No.: US 6,432,592 B1
(45) Date of Patent: Aug. 13, 2002

(54) SHADOW MASK FOR COLOR CRT

(75) Inventor: Seung Tae Ryu, Kumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/556,838

(22) Filed: Apr. 21, 2000

(30) Foreign Application Priority Data

Apr. 23, 1999 (KR) ..... 99-14552

(51) Int. Cl.[7] ..... H01J 29/07

(52) U.S. Cl. ..... 430/23; 313/402; 313/404; 313/407

(58) Field of Search ..... 430/23, 5, 4; 313/402, 313/404, 407

(56) References Cited

U.S. PATENT DOCUMENTS 3,722,043 A * 3/1973 Kirchner ..... 29/25.11
3,855,493 A * 12/1974 Snook et al. ..... 313/402
6,111,346 A * 8/2000 Ito et al. ..... 313/402

FOREIGN PATENT DOCUMENTS

JP 8-293266 A * 5/1996
JP 9-035657 A * 2/1997

* cited by examiner

*Primary Examiner*—John A. McPherson
(74) *Attorney, Agent, or Firm*—Birch, Stewart, Kolasch & Birch, LLP

(57) ABSTRACT

A shadow mask for a color CRT includes an effective face having a plurality of electron beam through holes and having a predetermined curvature; and a skirt unit extendedly bent at an outer portion of the effective face at a predetermined angle in the axial direction of the CRT, so as to be combined to a frame, wherein the skirt unit of the shadow mask has a plurality of vertical beads in parallel to the axial direction of the CRT and at least one horizontal bead formed crosswise in the lengthwise direction almost perpendicular to the vertical bead. With this structure, the strength property of the skirt unit of the shadow mask is improved to thereby minimize the widening degree of the skirt occurring in mounting the mask. Also, the curvature deformation such as mask sinking is prevented, thereby improving the quality of the color CRT.

19 Claims, 3 Drawing Sheets

SHADOW MASK FOR COLOR CRT

BACKGROUND OF THE INVENTION

1. Field of the Invention

The present invention relates to a shadow mask for a CRT, and more particularly, to a shadow mask for a CRT which is capable of preventing a curvature of an effective face of a shadow mask installed in a CRT from deforming, and facilitating welding a skirt portion to a frame of the shadow mask.

2. Description of the Background Art

A color CRT is a display instrument widely used for an observation of an oscilloscope or a radar as well as a television receiver.

The color CRT serves to transmit a color image for users' viewing which is reproduced. A florescent screen consisting of a red, green and blue florescent materials having three primary color light emitting spectrum of light, graphite, that is, an optical absorption substance, and an aluminum film for improving a luminance, are hit by an electronic beam. The electronic beam passes through a shadow mask functioning as an electrode by sections for the electronic beam just before it hits the florescent screen.

FIG. 1 is a sectional view of a general color CRT in accordance with a conventional art. As shown in the drawing, the color CRT adopting the shadow mask includes a panel 1 positioned at the front surface, a funnel 2 adhesively attached to the rear end of the panel 1, forming a vacuum outer casing container.

An electric gun 3 radiating an electron beam 10 is hermetically sealed inside a neck portion 12, that is, the end portion having relatively smaller diameter in the funnel 2. A deflection yoke 8 is mounted at the outer circumferential side of the neck portion 12, to deflect the radiated electron beam to the whole screen.

A florescent screen 4 made of red color (R), green (G) color and blue (B) color is formed on the inner surface of the panel 1, and a shadow mask 5 is positioned spaced apart for a predetermined distance from the florescent screen 4. The shadow mask 5 is supportedly combined by a frame 6 positioned inside thereof.

An inner shield 11 is combined to the inner end portion of the frame 6, preventing the deflected electron beam 10 from being influenced by an external magnetic field.

In the conventional color CRT constructed as described above, the electron beam 10 radiated form the electric gun 3 is deflected to a desired portion of the screen 4 by the vertical and horizontal deflection magnetic field and passes a plurality of through holes (not shown) formed at the shadow mask 5 to hit each florescent screen 4 made of the red color, green color and blue color by sections, thereby displaying an image.

In more detail, three electron beams 10 of red, green and blue color are radiated from the electric gun 3 to implement a color image, the three electron beams 10 respectively pass one through-hole of the shadow mask 5 and hit a corresponding florescent material pixel of the florescent screen 4, thereby displaying a desired color image.

FIGS. 2 and 3 illustrate a form of the shadow mask 5, of which FIG. 2 is a plan view of the shadow mask before being mounted and FIG. 3 is a perspective view of the shadow mask after being mounted.

As shown in the drawings, the shadow mask 5 includes an effective face 13 on which a plurality of through holes for passing the electron beam 10 are formed in a predetermined pattern, and a skirt unit 14, forming an edge of the effective face 13, is bent at the end portion of the effective surface 13 and half-etched. The skirt unit 14 has a predetermined length so as to be welded to the frame 6.

The skirt unit 14 is welded to the frame 6, rendering the shadow mask 5 to maintain a predetermined space with respect to the inner side of the panel 1.

FIG. 4 is a sectional view showing a curvature deformation state When the shadow mask of FIG. 3 is mounted. FIG. 5 is an enlarged sectional view showing the curvature deformation of the effective face occurring when the shadow mask mounted in the color CRT is combined to the frame.

In order to reduce a sinking phenomenon (A) of the effective face 13 occurring as the skirt unit 14 is widened outwardly due to the elasticity of the material of its own as shown in FIG. 4, and in order to prevent the deformation (B) of the curvature where the effective face 13 is moved outwardly as the skirt unit 14 is moved inwardly when the shadow mask 5 is combined to the frame 6 as shown in FIG. 5, a plurality of notches 15 are formed or a plurality of beads 16 are formed in the width direction of the skirt unit 14, to reinforce its strength.

Reference 'S' denotes a degree of the widening due to the elasticity of the skirt unit 14 itself.

However, as for the shadow mask for the color CRT in the conventional art, the sinking phenomenon (A) and the widening phenomenon (S) by the elasticity of the skirt unit 14 itself are prevented to a degree in the vicinity of the beads 16 by virtue of the plurality of beads 16, but such effect is degraded in the portions between the beads, generating the skirt-widening phenomenon depending the portions.

In addition, such widening phenomenon makes it difficult to position the end portion of the skirt unit and the end portion of the frame to the normal position for welding in assembling the mask to the frame, degrading a working efficiency. And, the deficiency in the assembly causes the deformation to the curvature of the effective face 13 of the shadow mask, degrading the property of the CRT.

SUMMARY OF THE INVENTION

Therefore, an object of the present invention is to provide a shadow mask for a color CRT having a reinforcing means successively operable along the outer diameter of a skirt unit of the shadow mask so as to reduce widening of the skirt unit when the mask is mounted as well as preventing curvature of an effective face from deforming.

Another object of the present invention is to provide a shadow mask for a color CRT for which the end portion of its skirt unit and the end portion of a frame are readily positioned at the normal portion in combining the skirt unit and the frame, thereby improving a working efficiency.

To achieve these and other advantages and in accordance with the purpose of the present invention, as embodied and broadly described herein, there is provided a shadow mask for a color CRT including: an effective face having a plurality of electron beam through holes and having a predetermined curvature; and a skirt unit extendedly bent at an outer portion of the effective face at a predetermined angle in the axial direction of the CRT, so as to be combined to the frame, the skirt unit of the shadow mask having a plurality of vertical beads in parallel to the axial direction of the CRT and at least one horizontal bead formed in the lengthy direction almost perpendicular to the vertical bead.

BRIEF DESCRIPTION OF THE DRAWINGS

The accompanying drawings, which are included to provide a further understanding of the invention and are incorporated in and constitute apart of this specification, illustrate embodiments of the invention and together with the description serve to explain the principles of the invention.

In the drawings.

DETAILED DESCRIPTION OF THE PREFERRED EMBODIMENTS

Figure 1:
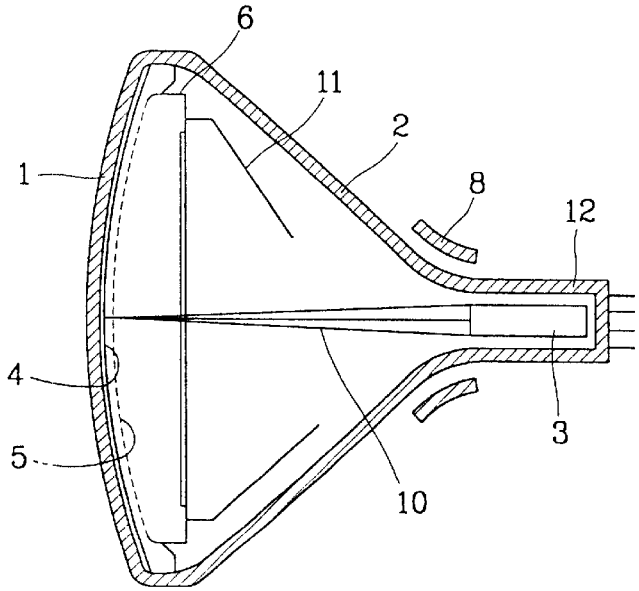
FIG. 1 CONVENTIONAL ART
FIG. 1 is a sectional view of a general color CRT in accordance with a conventional art.
Figure 2:
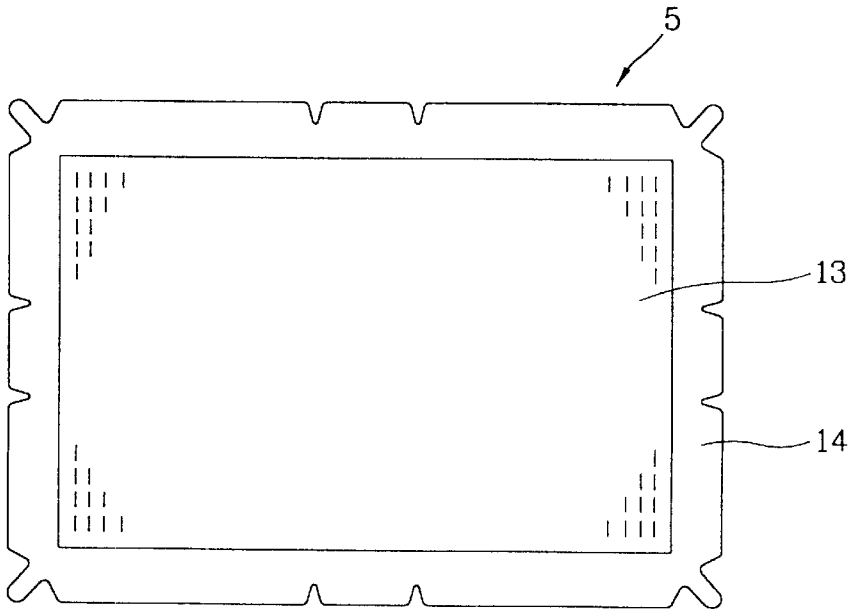
FIG. 2 CONVENTIONAL ART
FIG. 2 is a plan view of a shadow mask of the color CRT before being mounted on a frame in accordance with the conventional art.
Figure 3:
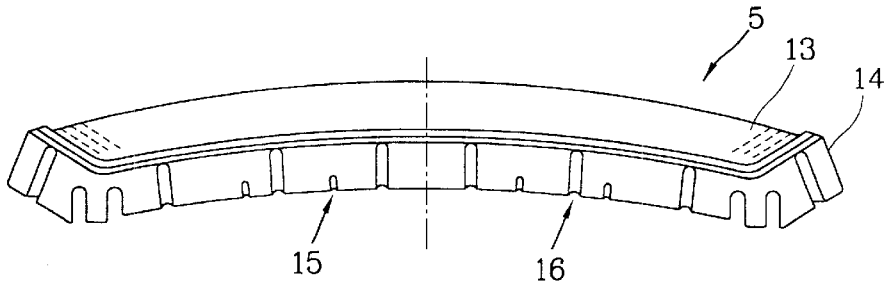
FIG. 3 CONVENTIONAL ART
FIG. 3 is a perspective view of a shadow mask of the color CRT after being mounted in accordance with the conventional art.
Figure 4:
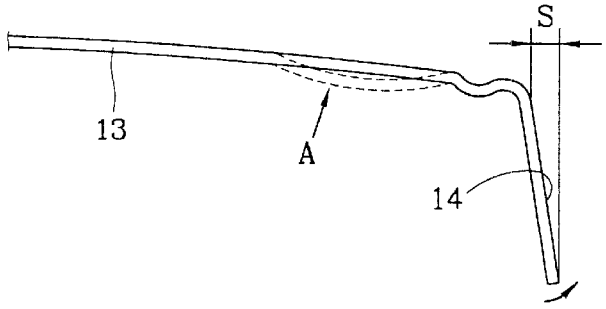
FIG. 4 CONVENTIONAL ART
FIG. 4 is a sectional view showing a curvature deformation state when the shadow mask of FIG. 3 is molded in accordance with the conventional art.
Figure 5:
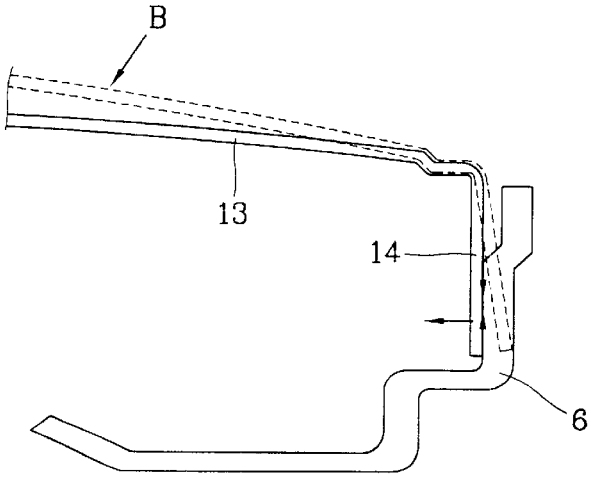
FIG. 5 CONVENTIONAL ART
FIG. 5 is an enlarged sectional view showing the curvature deformation of the effective face occurring when the shadow mask mounted in the color CRT is combined to the frame in accordance with the conventional art.

Reference will now be made in detail to the preferred embodiments of the present invention, examples of which are illustrated in the accompanying drawings.

The present invention may include a plurality of embodiments, of which most preferred embodiments are described herewith. Through the preferred embodiments, the objects, features and advantages of the present invention will be well understood.

Elements without denoting in the description of the present invention are the same as those of the conventional art, and thus, the same reference numerals are used for description of the present invention.

Figure 6:
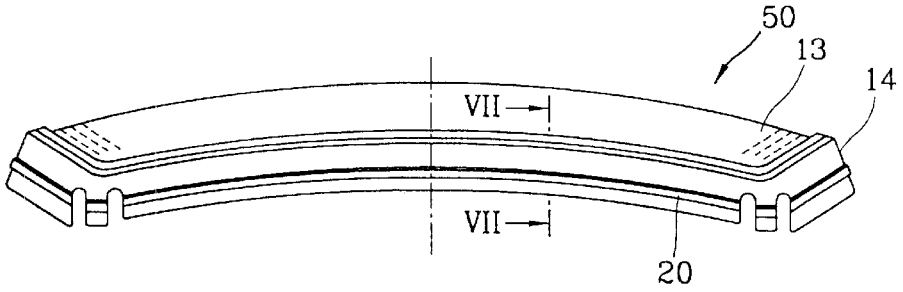
FIG. 6 is a perspective view of a shadow mask after it is mounted in the color CRT in accordance with one embodiment of the present invention.

As shown in FIG. 6, the shadow mask 50 of a color CRT in accordance with one embodiment of the present invention includes an effective face 13, facing a panel 1, forming a predetermined curvature, and a skirt unit 14 forming an edge of the effective face 13 bent at the end portion of the effective face 13 to be combined to the frame 6. A bead portion 20 extends in the length-wise direction along the entire region of the skirt unit 14.

Figure 7:
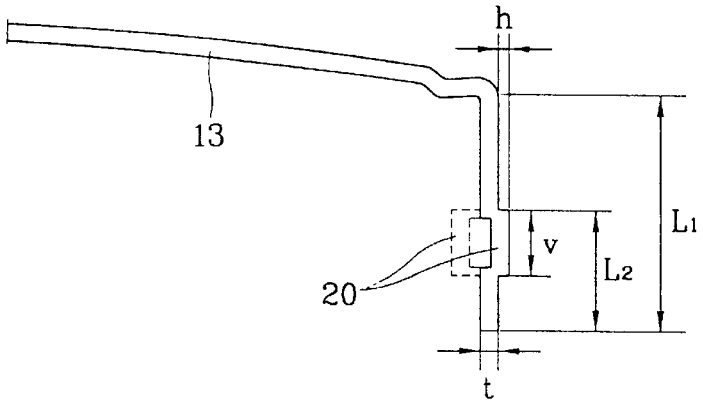
FIG. 7 is an enlarged sectional view of the shadow mask taken along line VII—VII of FIG. 6 in accordance with the present invention.

As shown in FIG. 7, the bead portion 20 is selectively protruded in the inner side or outer side of the skirt unit 14.

At this time, in order to have a desirable reinforcing effect, it is preferred that the bead portion 20 has the width of 0.1 $L_1$~0.8$L_1$ assuming that the length of the skirt unit is $L_1$, and has the protrusion height of 0.1t assuming that the thickness of the skirt unit 14 is 't'.

Preferably, the optimum reinforcing effect can be obtained where the width 'v' of the bead portion 20 is defined in the range of $0.3L_1<v<0.6L_1$, and the protrusion height 'h' of the bead portion 20 is defined to be 1.2t~3.5t over the thickness 't' of the skirt unit 14 in consideration of the space with respect to molding.

As to the width of the bead portion 20, if the distance $L_2$ from the outer end portion of the skirt unit 14 to the bead portion 20 is too short, a weak reinforcing effect may be realized, while if the distance $L_2$ from the outer end portion of the skirt unit 14 to the bead portion 20 is too long, molding of the bead portion 20 may become challenging.

Meanwhile, if the protrusion height 'h' of the bead portion 20 is below 1.2t, the effect of the bead may be hardly realized, while if the protrusion height 'h' of the bead portion 20 is above 3.5t, the molding of the shadow mask 50 may be spaced apart too much from the protrusion, which may cause formation of defective shadow masks during molding.

That is, due to the optimal reinforcing effect provided by the bead portion 20, the skirt unit 14 of the shadow mask 50 of the present invention is evenly reinforced for the whole outer diameter, and thus, when it is mounted to the frame 6, the widening of the skirt unit 14 is remarkably reduced and accordingly, the sinking phenomenon of the shadow mask is remarkably reduced.

For example, according to the result that the shadow mask of the present invention was applied to a model for 19" color CRT, it was observed that the widening degree in the skirt unit was reduced by more than 40% in its long side and short side.

In addition, generally, the elasticity of the skirt unit 14 becomes small as nearing its corner portion, and thus, the widening degree at the corner portion of the skirt unit is relatively small. Therefore, in the present invention, the width 'v' of the bead portion 20 and the protrusion height 'h' are gradually decreased as it goes toward the corner portion of each long and short side of the skirt unit, so that an appropriate strength distribution can be made. In the alternative, either the width 'v' or the protrusion height 'h' of the bead portion 20 is gradually decreased toward the corner portion of each side of the skirt unit.

That is, referring to the shadow mask of the conventional art, since the reinforcing structure of the skirt unit such as the bead or the notch are formed at predetermined intervals, it can not solve the problem of the widening phenomenon of the skirt. But, in the present invention, since the bead is consecutively formed in the lengthy direction of the skirt unit, an even strength reinforcement can be achieved along the entire outer circumferential face of the mask.

Resultantly, when the shadow mask of the present invention is combined to the frame, the end portion of the skirt unit and the end portion of the frame are easily positioned at the normal position, thereby improving a working efficiency, and at the same time, the deformation of the curvature at the effective surface portion of the shadow mask can be prevented.

In addition, since the strength of the mask is increased, the impact property of the shadow mask can be improved.

Figure 8:
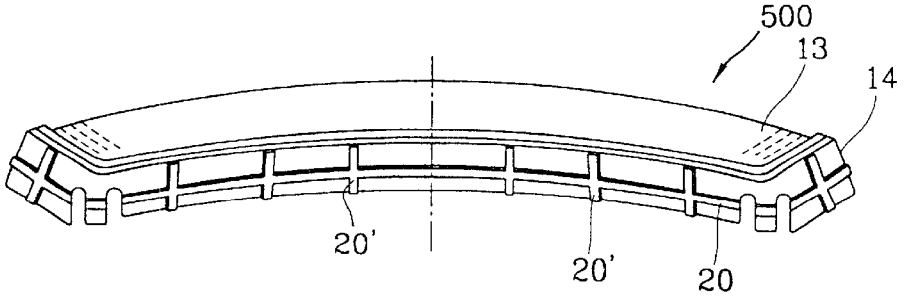
FIG. 8 is a perspective view of a shadow mask after it is mounted in the color CRT in accordance with one embodiment of the present invention.

FIG. 8 is a perspective view is a perspective view of a shadow mask after it is mounted in the color CRT in accordance with another embodiment of the present invention.

As shown in the drawing, besides the bead portion 20, one or more auxiliary bead portions 20' are additionally formed at predetermined intervals in the width-wise direction perpendicular to the bead portion 20. With this structure, the reinforcing force in the axial direction of the CRT can be further improved. The protrusion height of each of the bead portions 20' may be defined in the range of 1.2~3.5t given "t" equals the thickness of the skirt unit 14.

As so far described, according to the shadow mask for a CRT of the present invention, the strength property of the skirt unit of the shadow mask is improved to thereby minimize the widening degree of the skirt unit occurring during the mounting of the mask. Also, the curvature deformation such as mask sinking is prevented, thereby improving the quality of the color CRT As the present invention may be embodied in several forms without departing from the spirit or essential characteristics thereof, it should also be understood that the above-described embodiments are not limited by airy of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A shadow mask for a color CRT comprising:

an effective face part having a plurality of electron beam through holes and having a predetermined curvature; and a skirt unit extendedly bent at an outer portion of the effective face part at a predetermined angle in the axial direction of the CRT, wherein the skirt unit of the shadow mask has a plurality of vertical beads in parallel to the axial direction of the CRT and at least one horizontal bead formed in the lengthwise direction extending across the vertical beads, wherein the width of the horizontal bead and the protrusion height of the horizontal bead are decreased toward a corner of the skirt unit.

2. The shadow mask according to claim 1, wherein the plurality of vertical beads are formed at predetermined intervals in the cross direction to the horizontal bead.

3. The shadow mask according to claim 2, wherein the protrusion height of each of the vertical beads is defined in the range of 1.2t~3.5t where the thickness of the skirt unit is 't'.

4. The shadow mask according to claim 1, wherein the protrusion height of the horizontal bead is defined in the range of 1.2t~3.5t where the thickness of the skirt unit is 't'.

5. The shadow mask according to claim 1, wherein the horizontal bead is formed at the inner side of the skirt unit.

6. The shadow mask according to claim 1, wherein the width of the horizontal bead is defined in the range of $0.3L_1<V<0.6L_1$ where the length of the skirt unit of shadow mask is defined "$L_1$" and the width of the horizontal bead is defined "V".

7. The shadow mask according to claim 1, wherein each of the vertical and horizontal beads projects outwardly to provide a projection on the outer surface of the skirt unit.

8. The shadow mask according to claim 1, wherein each of the horizontal and vertical beads projects inwardly to provide an indentation on the outer surface of the skirt unit.

9. The shadow mask according to claim 1, wherein the vertical beads are provided substantially perpendicular to the horizontal bead.

10. The shadow mask according to claim 1, wherein the horizontal bead has a width in the range of $0.1L_1$–$0.8L_1$ where the length of the skirt unit is defined "$L_1$".

11. A shadow mask for a color CRT, comprising:

an effective face part for receiving electron beams; and a skirt unit extending along the effective face part, the skirt unit including a plurality of vertical beads in parallel with an axial direction of the CRT and at least one horizontal bead formed in a lengthwise direction extending across the vertical beads, wherein at least one of a width and a protrusion height of the horizontal bead is decreased toward at least one corner of the skirt unit.

12. The shadow mask according to claim 11, wherein the width of the horizontal bead is defined in the range of $0.3L_1<V<0.6L_1$ where the length of the skirt unit of shadow mask is defined "$L_1$" and the width of the horizontal bead is defined "V".

13. The shadow mask according to claim 11, wherein the horizontal bead has a width in the range of $0.1L_1$–$0.8L_1$ where the length of the skirt unit is defined $L_1$.

14. The shadow mask according to claim 11, wherein the protrusion height of the horizontal bead is defined in the range of 1.2t~3.5t where the thickness of the skirt unit is 't'.

15. The shadow mask according to claim 11, wherein the protrusion height of the vertical beads is defined in the range of 1.2t~3.5t, where the thickness of the skirt unit is 't'.

16. The shadow mask according to claim 11, wherein each of the vertical and horizontal beads projects outwardly to provide a projection on the outer surface of the skirt unit.

17. The shadow mask according to claim 11, wherein each of the horizontal and vertical beads projects inwardly to provide an indentation on the outer surface of the skirt unit.

18. The shadow mask according to claim 11, wherein the vertical beads are provided substantially perpendicular to the horizontal bead.

19. A shadow mask for a color CRT having a frame including a connecting portion almost parallel to an axial axis direction of the CRT, said shadow mask comprising:

an effective face part having a plurality of electron beam through holes and having a predetermined curvature; and a skirt unit extendedly bent at an outer portion of the effective face part in the axial direction of the CRT for connecting to the frame, wherein the skirt unit of the shadow mask includes a plurality of vertical beads in parallel to the axial direction of the CRT and at least one horizontal bead formed crosswise perpendicular to the vertical beads, and a protrusion height of the horizontal bead is defined in the range of 1.2t~3.5t where a thickness of the skirt unit is 't'.

* * * * *